US006607401B1

(12) United States Patent
Weaver, Jr. et al.

(10) Patent No.: US 6,607,401 B1
(45) Date of Patent: Aug. 19, 2003

(54) ELECTRICAL CONNECTOR MATEABLE IN A PLURALITY OF ORIENTATIONS

(75) Inventors: John H. Weaver, Jr., Marietta, PA (US); Timothy B. Billman, Dover, PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/494,322

(22) Filed: Jan. 28, 2000

Related U.S. Application Data

(60) Provisional application No. 60/117,957, filed on Jan. 28, 1999.

(51) Int. Cl.[7] ..... H01R 13/648

(52) U.S. Cl. ..... 439/608; 439/108; 439/217

(58) Field of Search ..... 439/65, 66, 74, 439/217, 218, 223, 224, 607, 608, 221–222, 108

(56) References Cited

U.S. PATENT DOCUMENTS

| | | | | | |
|---|---|---|---|---|---|
| 3,596,235 | A | * | 7/1971 | Gerardus | 439/749 |
| 3,686,617 | A | * | 8/1972 | Uberbacher | 439/595 |
| 4,703,394 | A | * | 10/1987 | Petit et al. | 439/544 |
| 4,838,798 | A | * | 6/1989 | Evans et al. | 439/65 |
| 4,850,887 | A | * | 7/1989 | Sugawara | 439/108 |
| 4,975,084 | A | | 12/1990 | Fedder et al. | |
| 4,979,904 | A | * | 12/1990 | Francis | 439/620 |
| 4,997,376 | A | * | 3/1991 | Buck et al. | 439/59 |
| 5,194,020 | A | | 3/1993 | Voltz | 439/579 |
| 5,228,863 | A | * | 7/1993 | Campbell et al. | 439/65 |
| 5,266,059 | A | | 11/1993 | Taylor | 439/912 |
| 5,281,147 | A | * | 1/1994 | Hughes | 439/171 |
| 5,296,748 | A | * | 3/1994 | Wicklund et al. | 439/65 |
| 5,335,146 | A | * | 8/1994 | Stucke | 439/65 |
| 5,429,521 | A | * | 7/1995 | Morlion et al. | 439/108 |
| 5,433,618 | A | * | 7/1995 | Morlion et al. | 439/217 |
| 5,500,788 | A | | 3/1996 | Longueville et al. | 361/800 |
| 5,588,844 | A | * | 12/1996 | Sipe | 439/65 |
| 5,620,340 | A | | 4/1997 | Andrews | |
| 5,660,551 | A | * | 8/1997 | Sakurai | 439/108 |
| 5,766,040 | A | * | 6/1998 | Naerland et al. | 439/608 |
| 5,795,191 | A | | 8/1998 | Preputnick et al. | |
| 5,949,656 | A | * | 9/1999 | Pinault | 439/65 |
| 6,039,583 | A | * | 3/2000 | Korsunsky et al. | 439/607 |
| 6,083,047 | A | * | 7/2000 | Paagman | 439/608 |
| 6,111,756 | A | * | 8/2000 | Moresco | 439/65 |
| 6,116,926 | A | * | 9/2000 | Oretega et al. | 439/108 |
| 6,290,079 | B1 | * | 9/2001 | Altherr | 439/195 |
| 6,343,955 | B2 | * | 2/2002 | Billman et al. | 439/608 |
| 6,364,710 | B1 | * | 4/2002 | Billman et al. | 439/608 |

FOREIGN PATENT DOCUMENTS

| | | |
|---|---|---|
| DE | 41 03 634 | 8/1992 |
| HU | 185565 B | 4/1984 |
| JP | 09326281 A | 6/1996 |

* cited by examiner

*Primary Examiner*—Renee Luebke
*Assistant Examiner*—Felix O. Figueroa
(74) *Attorney, Agent, or Firm*—Harrington & Smith, LLP

(57) ABSTRACT

An interconnection system, comprising: a first connector having an arrangement of contacts therein; and a second connector, mateable with said first connector, and having an arrangement of contacts therein. The second connector can mate with the first connector in a plurality of orientations. An electrical connector, comprising: an insulative housing; and a plurality of contacts in said insulative housing. The connector has four quadrants, with each quadrant housing some of the contacts in an orientation. Each quadrant has an orientation that is different than the other quadrants.

19 Claims, 15 Drawing Sheets

ELECTRICAL CONNECTOR MATEABLE IN A PLURALITY OF ORIENTATIONS

CROSS-REFERENCE TO RELATED APPLICATION

This application claims the benefit under 35 U.S.C. §119 (e) of provisional patent application No. 60/117,957 filed Jan. 28, 1999, which is hereby incorporated by reference.

BACKGROUND OF THE INVENTION

1. Field of the Invention

The present invention relates to electrical connectors. More specifically, the present invention relates to high speed electrical connectors.

2. Brief Description of Earlier Developments

Conventional high speed connectors generally only allow mating with a corresponding connector in one orientation. One reason for the limited mateability of high speed connectors is the shape of the connectors. Most high speed connectors have a rectangular shape. In other words, the high speed connector has an unequal number of contact rows to contact columns. Thus, the connectors can only mate when the rows of one connector align with the rows of the corresponding connector.

Another reason for the limited mateability of high speed connectors is the arrangement of the signal and ground contacts. Typically, the orientation of the signal and ground contacts remains the same across the length of the connector. This "polarization" of the high speed connector helps control the electrical characteristics of the connector. As a consequence, however, these connectors can only mate in one specific orientation.

These "polarized" connectors, while providing high speed interconnections, exhibit unbalanced contact forces. Each contact produces forces in the connector having generally the same direction as the forces created by the other contacts. The unbalanced forces may, for example, affect the quality of the solder joint at the through hole on the board, increase insertion forces, or reduce the life span of the connector.

SUMMARY OF THE INVENTION

It is an object of the present invention to provide an improved high speed electrical connector.

It is a further object of the present invention to provide a selectively mateable electrical connector.

It is a further object of the present invention to provide an electrical connector capable of mating with a corresponding connector in a plurality of orientations.

It is a further object of the present invention to provide an electrical connector having a symmetrical contact arrangement.

It is a further object of the present invention to provide an electrical connector having balanced contact forces.

These and other objects of the present invention are achieved in one aspect of the present invention by an interconnection system, comprising: a first connector having an arrangement of contacts therein; and a second connector, mateable with the first connector, and having an arrangement of contacts therein. The second connector can mate with the first connector in a plurality of orientations.

These and other objects of the present invention are achieved in another aspect of the present invention by an electrical connector, comprising: an insulative housing; and a plurality of contacts in said insulative housing. The connector has four quadrants, with each quadrant housing some of the contacts in an orientation. Each quadrant has an orientation different than the other quadrants.

BRIEF DESCRIPTION OF THE DRAWINGS

Other uses and advantages of the present invention will become apparent to those skilled in the art upon reference to the specification and the drawings, in which.

DETAILED DESCRIPTION OF THE PREFERRED EMBODIMENTS

Figure 1A:
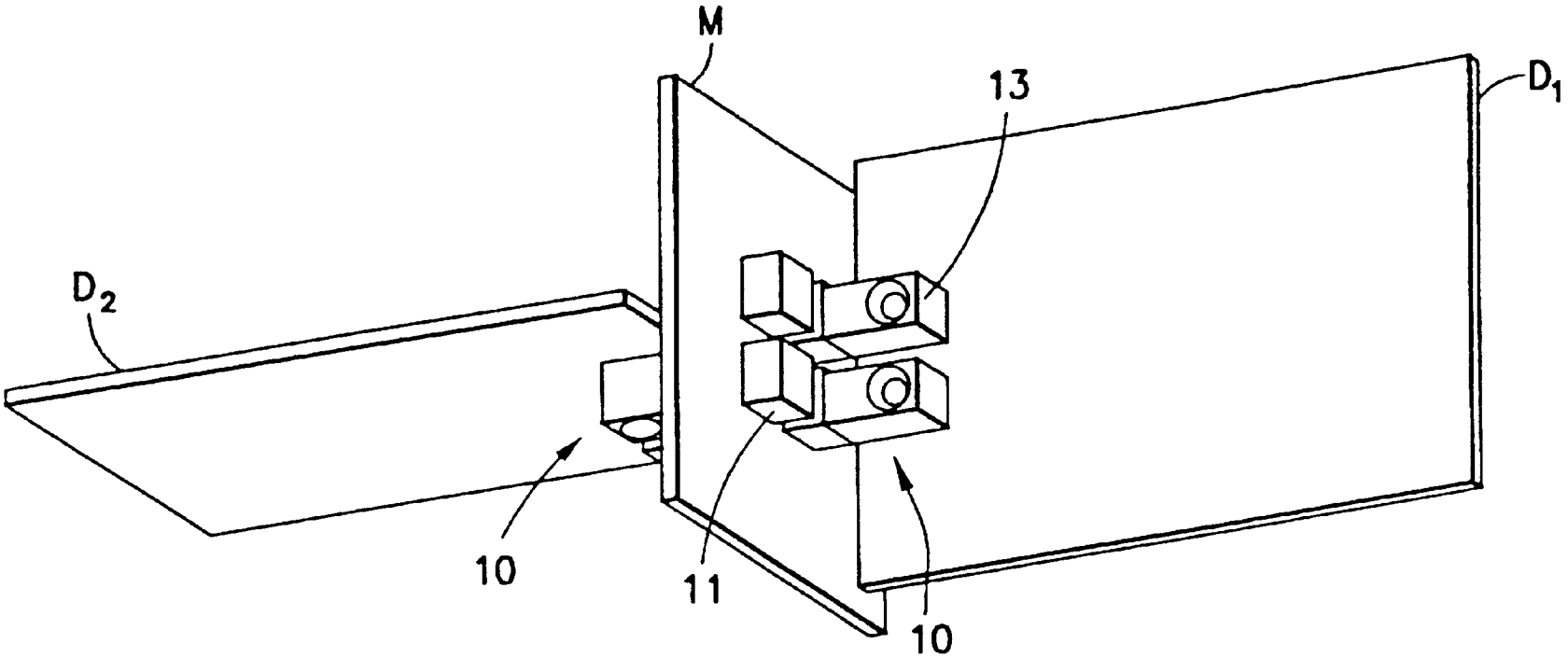
FIGS. 1*a* and 1*b* are different perspective views of the present invention in use.
Figure 1B:
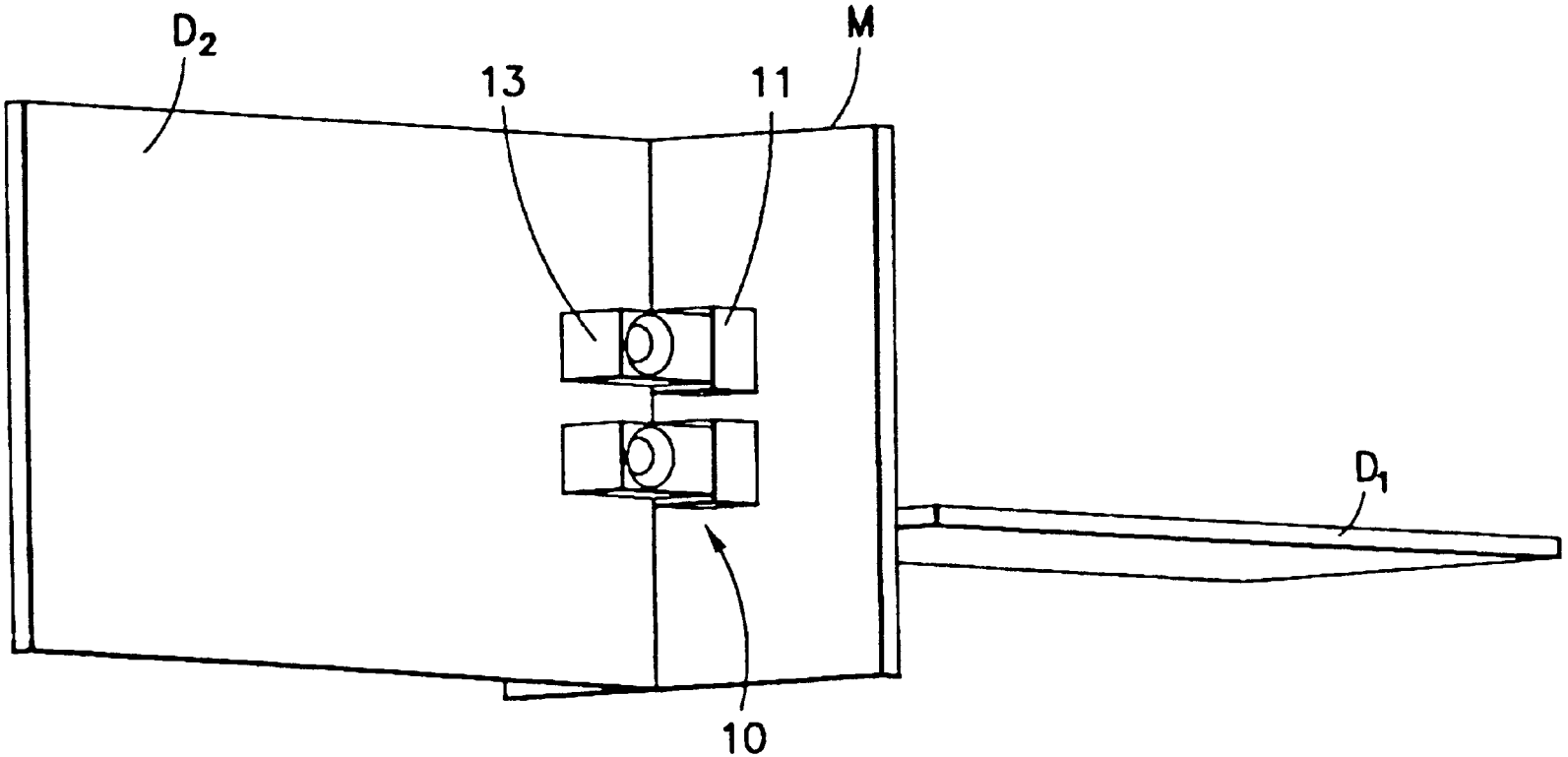
Figure 1C:
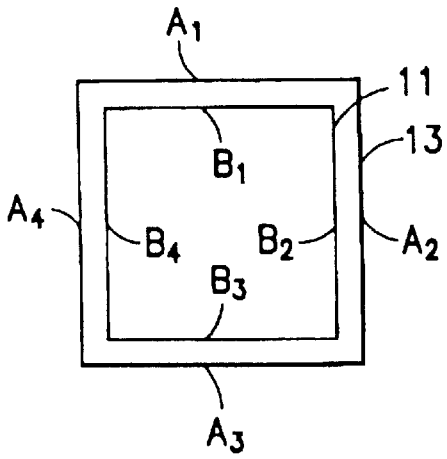
FIGS. 1*c*–1*f* are schematic views of four possible different mating positions of a receptacle with a header.
Figure 1D:
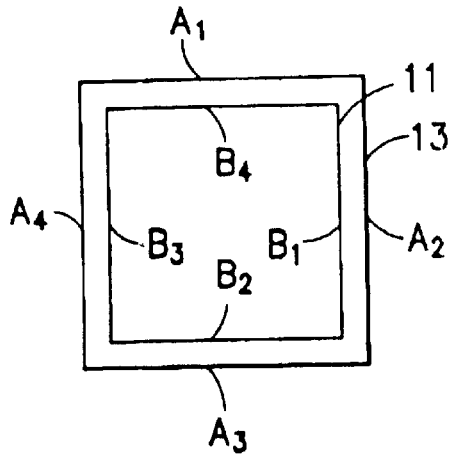
Figure 1E:
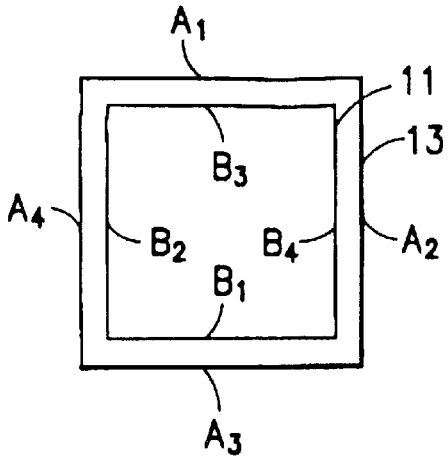
Figure 1F:
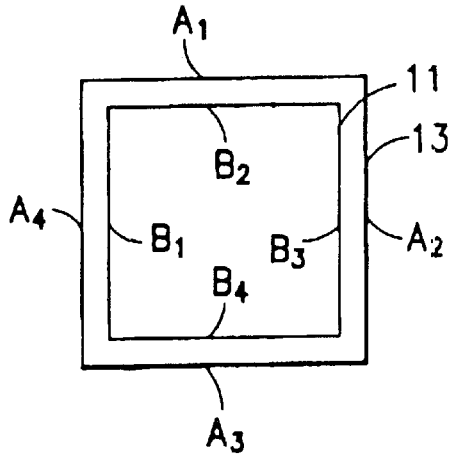

The present invention, generally speaking, allows for the interconnection of two or more electrical or electronic components, such as printed circuit board substrates, in a plurality of orientations. As seen in FIGS. 1*a* and 1*b*, interconnection systems 10 can secure daughterboards D1, D2 to a backplane or motherboard M. In alternate embodiments the interconnection system could connect more or less than two daughterboards to the motherboard and, the daughterboard(s) could be located merely on one side of the motherboard. Daughterboards D1, D2 can secure to motherboard M in a plurality of orientations. Although FIGS. 1*a* and 1*b* demonstrate daughterboard D1 in a horizontal orientation and daughterboard D2 in a vertical orientation, the flexibility of the interconnection systems 10 allow each of the daughterboards D1, D2 to secure to motherboard M in at least four orientations. A more detailed discussion of interconnection system 10 follows.

Interconnection system 10 includes at least two connectors, such as a header 11, and a receptacle 13. In this embodiment the receptacle 13 is a right angle receptacle. However, in alternate embodiments, any suitable receptacle could be provided, such as when the boards M and D1 and/or D2 are intended to be connected parallel to each other. In addition, in an alternate embodiment the header 11 could be located on the daughterboard and the receptacle could be located on the motherboard. Header 11 and receptacle 13 can secure to daughterboards D1, D2 or motherboard M using known techniques, which warrant no further discussion. Preferably, interconnection system 10 uses a single ended arrangement for transmitting signals between daughterboards D1, D2 and motherboard M. In this embodiment each system 10 includes four of the headers 11 and two of the receptacles 13. However, in alternate embodiments more or less than four headers could be provided and more or less than two receptacles could be provided. Referring also to FIGS. 1*c*–1*f*, the headers 11 and receptacle 13 are connectable to each other in four orientations; 90° offset. Sides $A_1$–$A_4$ can be located at sides $B_1$–$B_4$ in the four positions shown. When multiple connectors are used, some may be left empty or unconnected as shown in FIG. 1*a*. The connectors 11, 13 may also be arranged to mount daughterboards D1 and/or D2 to the mother board M in more or less than four orientations.

Figure 2A:
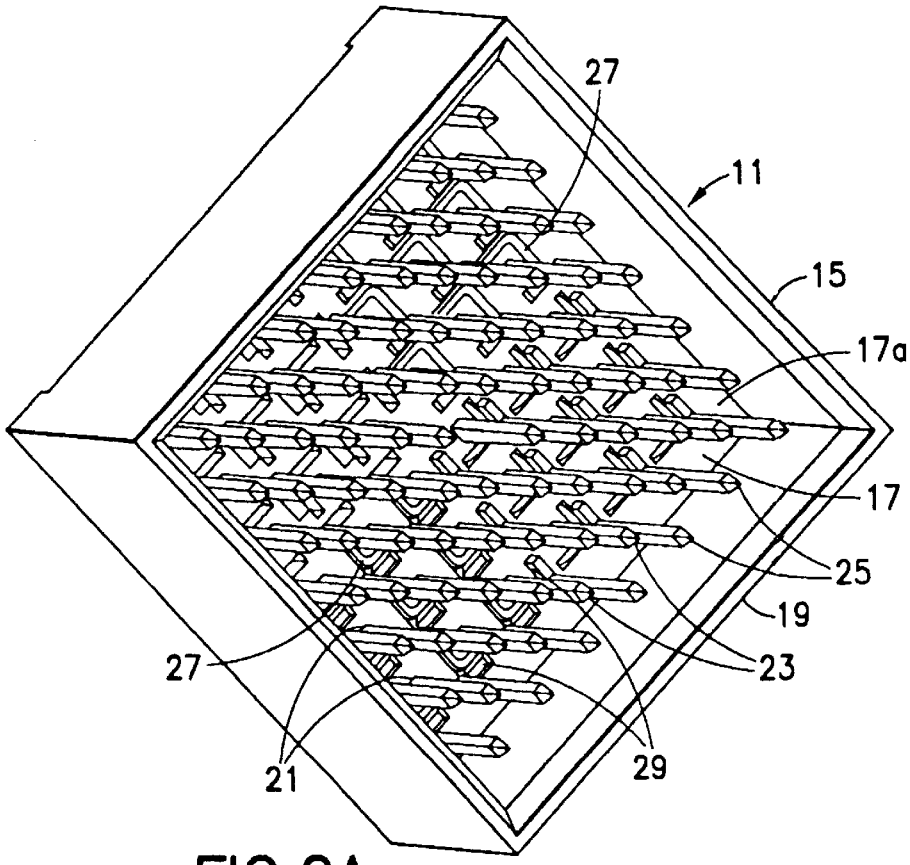
FIGS. 2*a* and 2*b* are perspective views of a first component of the present invention.
Figure 2B:
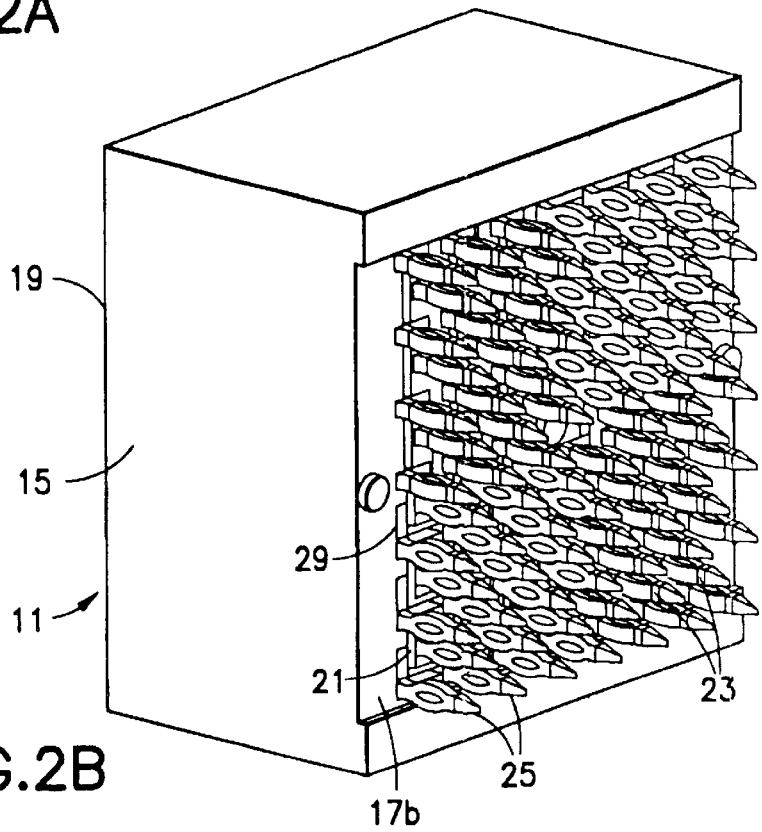

FIGS. 2A and 2B display one of the headers 11 prior to mounting to motherboard M. Header 11 includes an insulative housing 15. Housing 15 includes a base 17 surrounded by a shroud 19. Base 17 includes apertures 21 sized to receive signal contacts, or pins 23. Signal pins 23 extend outwardly from both the mating face 17*a* and the mounting face 17*a* of header 11. An array of ground contacts, or pins 25, and ground shields 27 surround sides of each signal pin 23. Apertures 29 in base 17 are sized to receive ground pins 25 and ground shields 27. As with signal pins 23, ground pins 25 extend outwardly from both the mating face 17*a* and mounting face 17*b* of header 11. Ground shields 27, however, remain within base 17. Ground pins 25 and ground shields 27 directly contact each other in order to provide continuity.

One of the receptacles 13 will now be described with reference to FIGS. 3*a*, 3*b*, 4*a*–*c*, 5 and 6. Several components form receptacle 13, including a rear housing 31, modules 33 and a front housing 35. However, in alternate embodiments, more or less components can be provided. Each component will be described in more detail.

Rear housing 31 is generally an open structure formed by sidewalls 36, 37; a rear wall 39; and a top wall 41. The open interior of rear housing 31 receives the rear portions of a series of modules 33 arranged side-by-side. Receptacle 13 accurately rests on daughterboard D1, D2 using alignment posts 43 extending downwardly from sidewalls 36, 37. Alignment posts 43 engage corresponding through holes (not shown) in daughterboard D1, D2.

Front housing 35 is also generally an open structure formed by a mating face 45; sidewalls 47, 49; bottom wall 51; and top wall 53. The open interior of front housing 35 receives the front portions of a series of modules 33 arranged side-by-side. Front housing 35 secures to rear housing 31 using latch structures 55, 57 on each housing, respectively. Front housing 35 secures to rear housing 31 after placement of modules 33 within rear housing 31. Once assembled, receptacle 13 can mount to a daughterboard D1, D2.

Mating face 45 of front housing 35 includes an array of lead-ins 59. Lead-ins 59 accept corresponding signal pins 23 and ground pins 25 from header 11. Once header 11 mates with receptacle 13, the signal and ground contacts of receptacle 13 engage signal pins 23 and ground pins 25 of header 11. This feature will be described in more detail below.

Figure 4A:
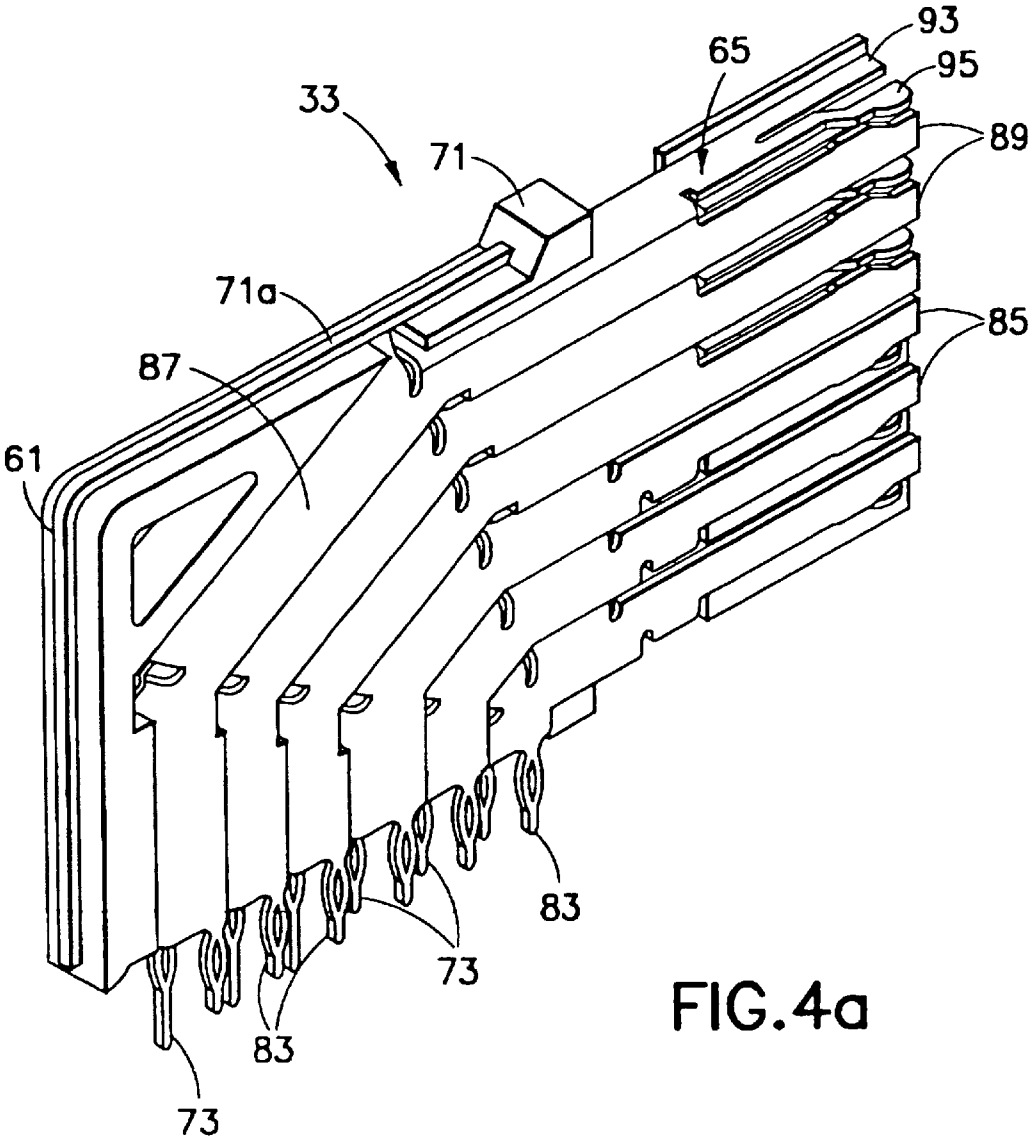
FIG. 4*a* is a perspective view of a sub-assembly of the second component of the present invention.
Figure 4B:
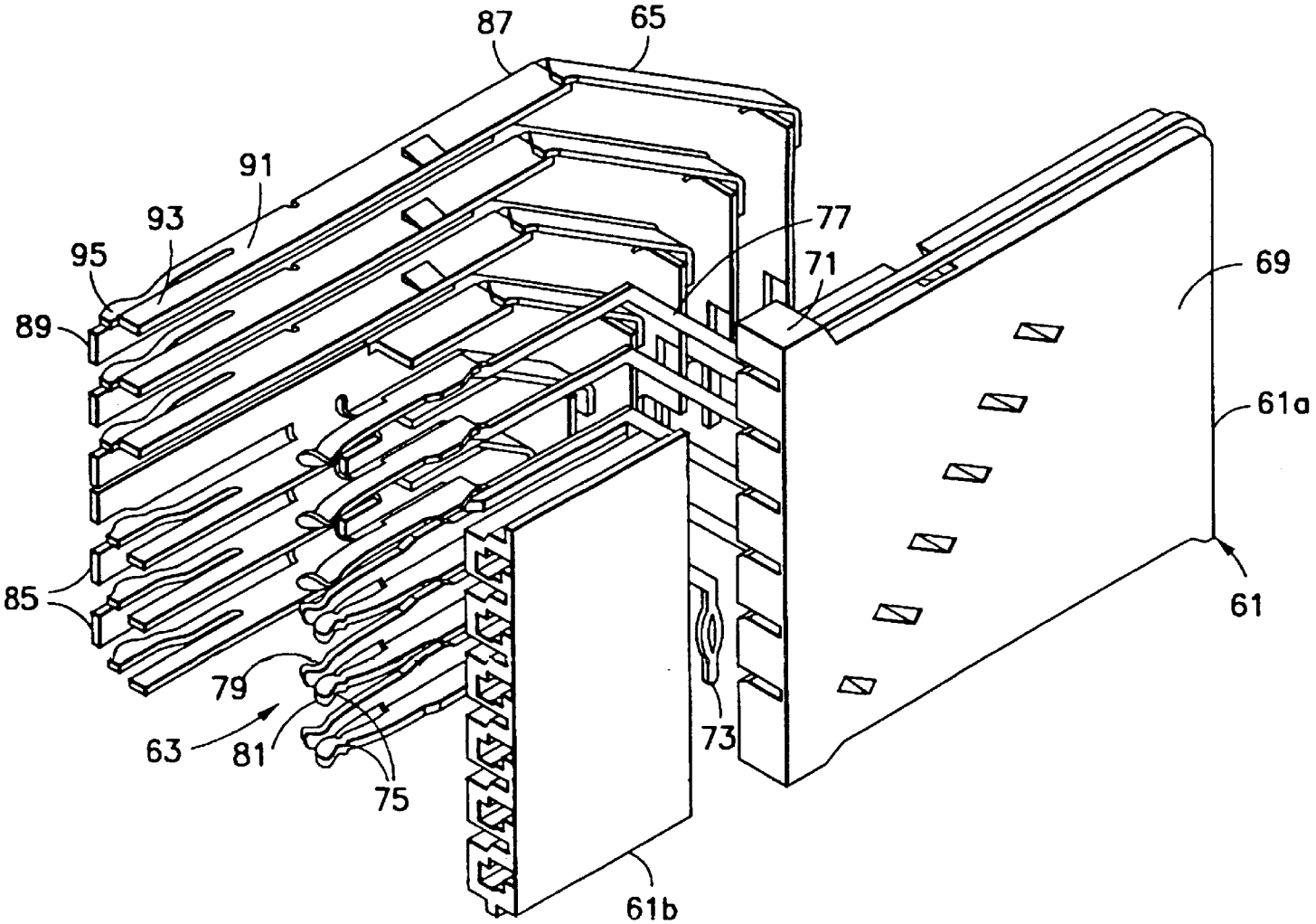
FIGS. 4*b* and 4*c* are different exploded, perspective views of the sub-assembly of the second component of the present invention shown in FIG. 4*a;*
Figure 4C:
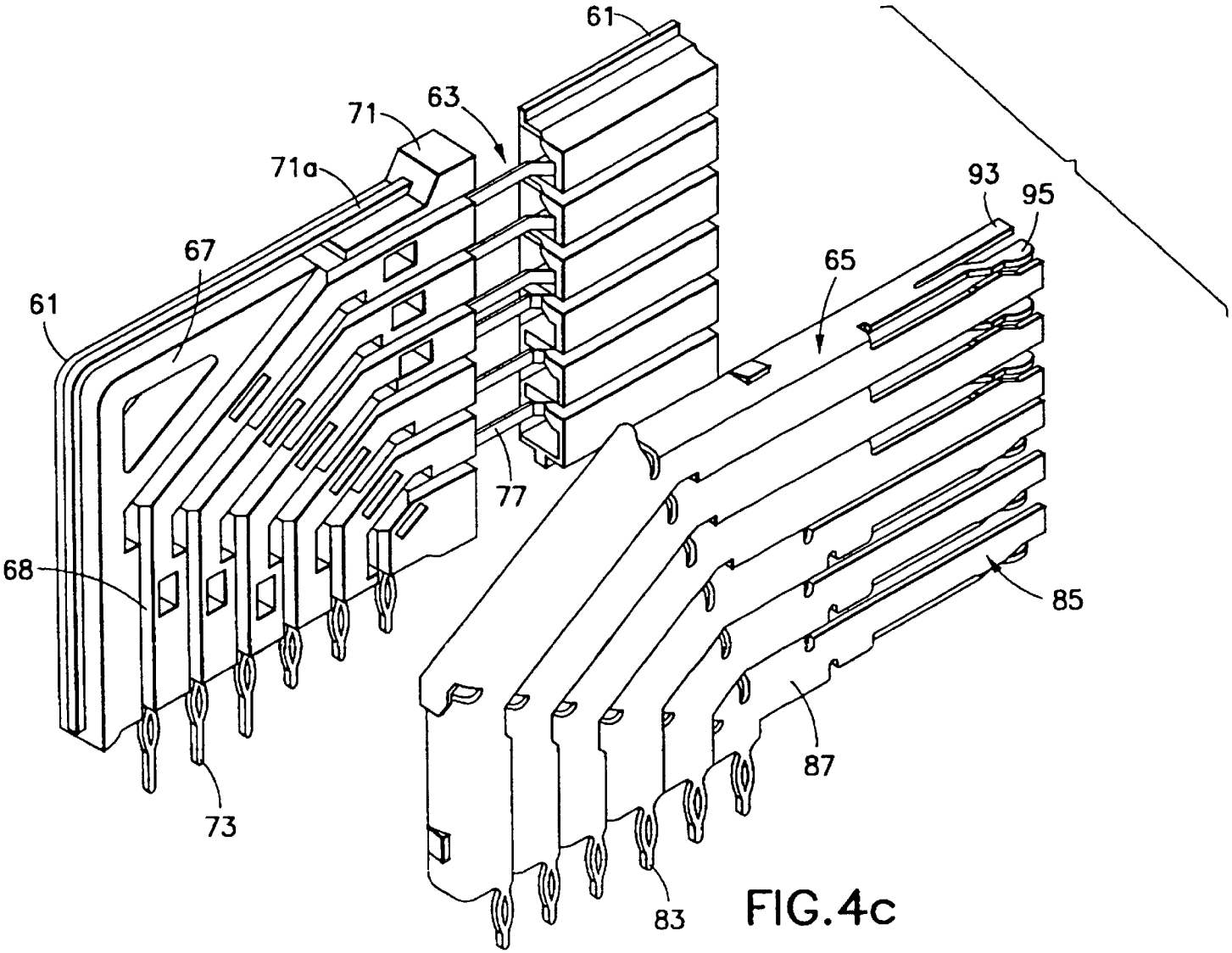

Modules 33 contain the signal and ground contacts for receptacle 13. As seen in FIGS. 4*a*–*c*, several components form modules 33. Modules 33 include a wafer 61, signal contacts 63 and ground contacts 65. However, in alternate embodiments, more components could be provided, and/or the components need not be provided as uniform modules. Wafer 61 can be a block of insulative material. As seen in FIG. 4*b*, wafer 61 can be formed from several pieces 61*a*, 61*b*. Alternatively, however, wafer 61 could be formed unitarily from one piece.

Figure 3B:
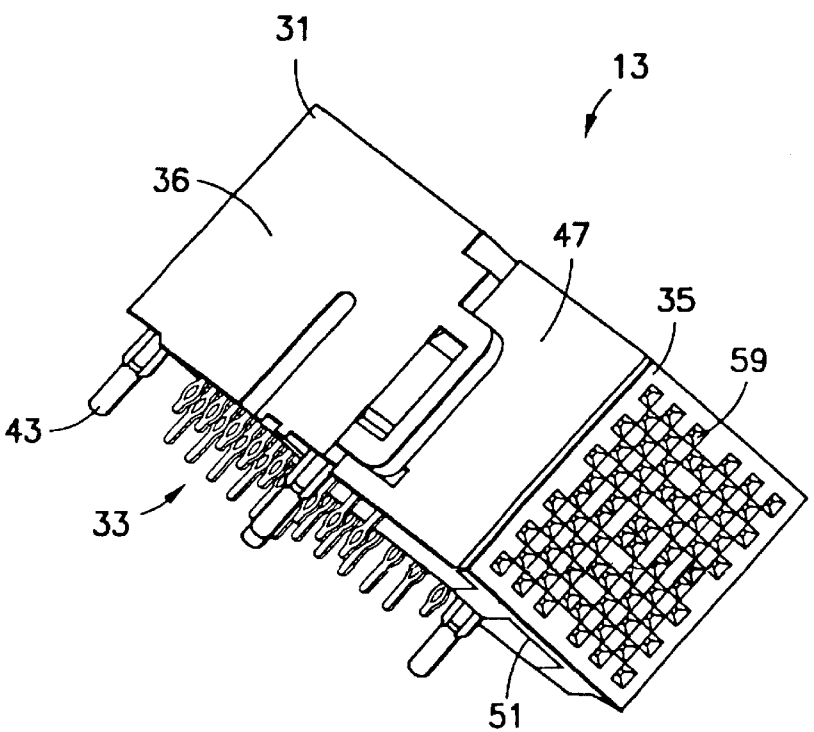
FIGS. 3*a* and 3*b* are different perspective views of a second component of the present invention.
Figure 3A:
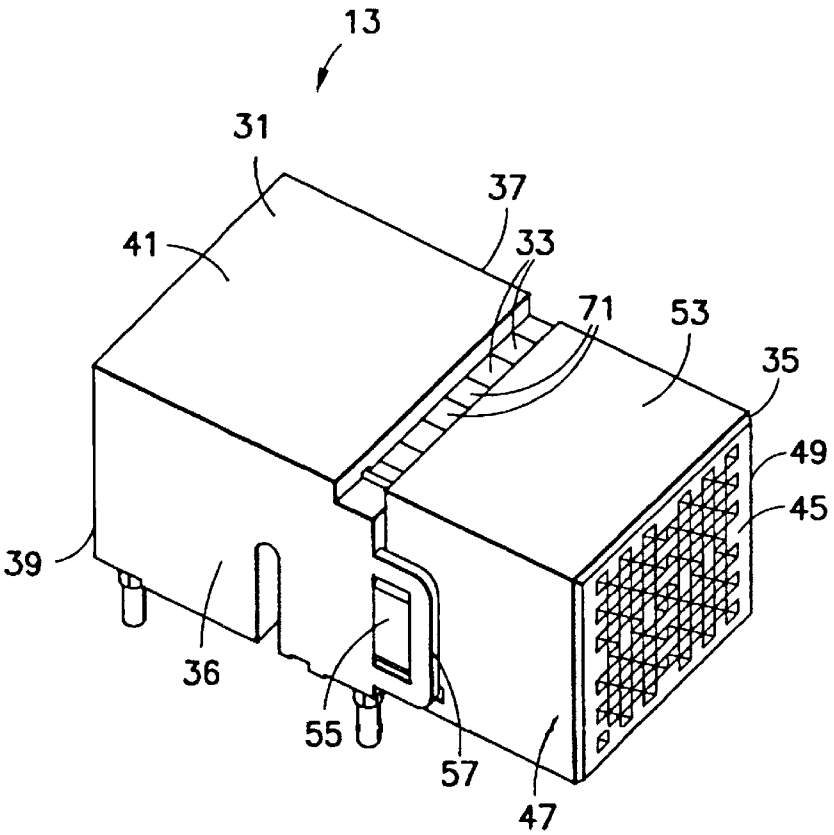

As seen best in FIG. 4*c*, a first major surface 67 of wafer 61 has a series of channels, grooves or apertures 68 in which signal contacts 63 and/or ground contacts 65 reside. When arranging modules 33 side-by-side, first major surface 67 of a first module 33 can abut a second major surface 69 of a second adjacent module 33. In order to place modules 33 side-by-side, second major surface 69 can be generally featureless as shown in FIG. 4*b*. The top surface of wafer 61 includes a projection 71. As seen in FIG. 3A, projection 71 can abut the front edge of rear housing 31 during, and after, assembly. The interaction between projections 71 and the front edge of rear housing 31 helps align modules 33 within rear housing 31. The wafer 61 can also have a spine 71*a*. The spine 71*a* can be located in a groove (not shown) in the rear housing 31.

Signal contacts 63 include a mounting end 73 for securing to daughterboard D1, D2, a mating end 75 for interacting with signal pins 23 of header 11, and an intermediate portion 77. FIGS. 4*a*–*c* demonstrate mounting ends 73 as having press-fit tails that engage plated through holes (not shown) in daughterboard D1, D2. However, other types of terminations for mounting ends 73 could be used. Typically, an over-molding process embeds signal contacts 63 in wafer 61. However, other techniques could be used.

Mating end 75 can have a dual beam contact to engage signal pins 23 of header 11. As seen in FIG. 4*b*, beams 79, 81 of the dual beam contact are arranged generally perpendicular to each other. In this arrangement, the bifurcation engages adjacent surfaces of signal pins 23. Beams 79, 81 deflect upon insertion of signal pins 23. The movement of signal pins 23 along beams 79, 81 during insertion provides good wiping action. In addition, the force imparted to signal pins 23 by the deflection of the beams 79, 81 provides good contact pressure or contact normal force.

As with signal contacts 63, ground contacts 65 include a mounting end 83 for securing to daughterboard D1, D2, a mating end 85 for interacting with ground pins 25 of header 11, and an intermediate portion 87. FIGS. 4*a*–*c* demonstrate mounting ends 83 as having press-fit tails that engage plated through holes (not shown) in daughterboard D1, D2. However, other types of terminations for mounting ends 83 could be used. Mating end 85 uses a dual beam-type contact arrangement to engage ground pins 25 of header 11. Mating end 85 includes a first beam 89 arranged generally perpendicular to a second beam 91. A minor surface of first beam 89 supports the ground pin 25. As discussed above, the beam 89 provides good contact force and wipe. As seen in FIGS. 4*a*–*c*, second beam 91 is bifurcated into a stationary section 93 and a movable section 95. Upon engagement of movable section 95 of second beam 91 with ground pin 25, movable section 95 deflects. As with the other contacts, the deflection provides good contact force and wipe.

Figure 5:
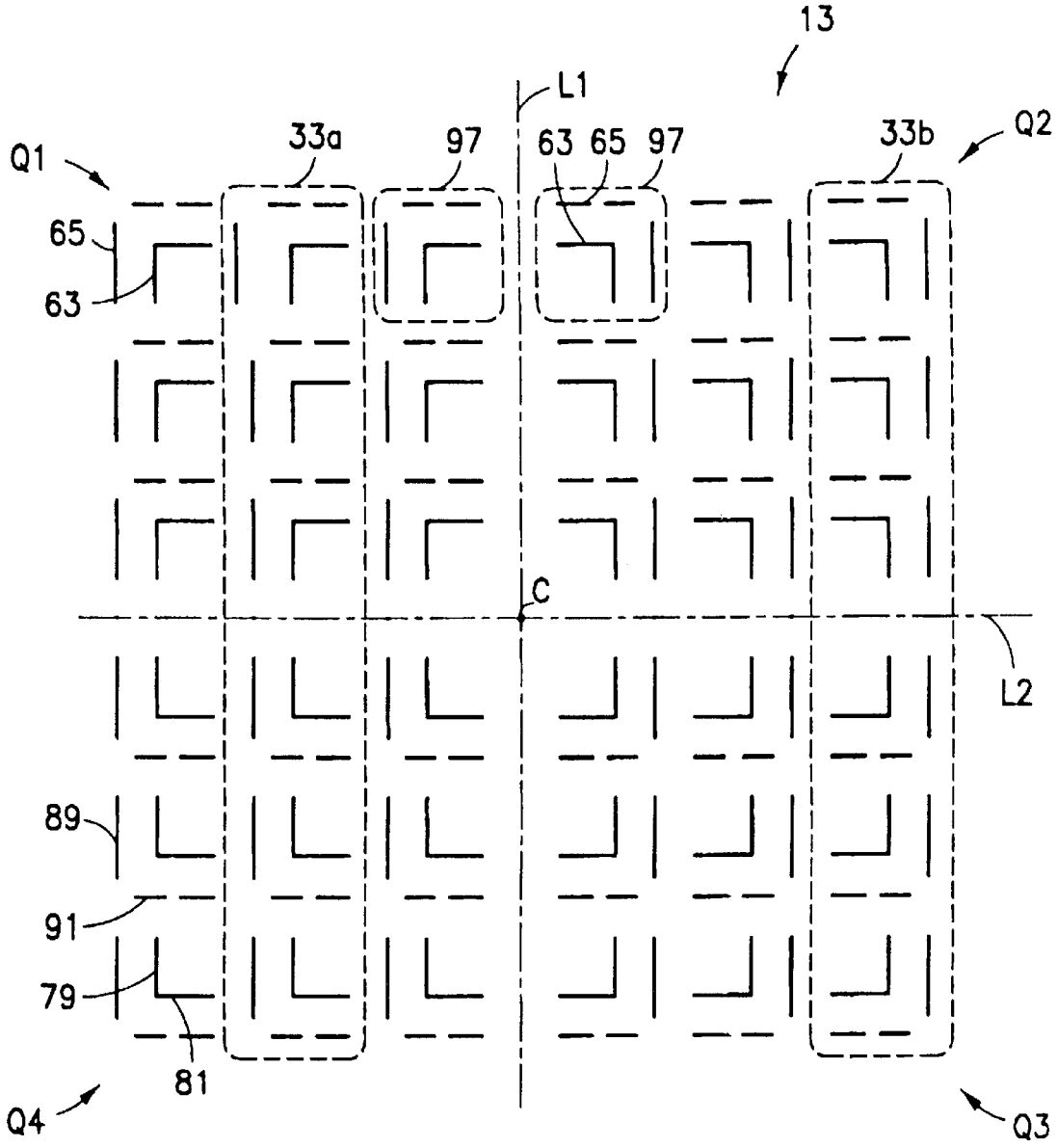
FIG. 5 is a schematic representation of the contact arrangement for the second component of the present invention shown in FIGS. 3*a* and 3*b;*

Signal contacts 63 within module 33, as with ground contacts 65 within module 33, preferably do not maintain the same orientation throughout module 33. Furthermore, signal contacts 63 and ground contacts 65 in one module 33 preferably do not exhibit the same orientation as signal contacts 63 and ground contacts 65 in all of the other modules 33. FIG. 5 helps clarify the arrangement of the signal contacts 63 and ground contacts 65 in modules 33.

FIG. 5 provides a schematic representation of six of the modules 33 connected side-by-side with signal contacts 63 and ground contacts 65 to form receptacle 13. In alternate embodiments more or less than six modules could be used. In this embodiment the six modules 33 actually comprise two types of modules 33*a*, 33*b* which are mirror images of each other. In alternate embodiments more or less than two types of modules could be provided and, the modules need not be mirror images of each other. The general L shape of the signal contacts 63 generally correspond to the positions of the beams 79, 81. Likewise, the general L shape of the ground contacts 65 generally correspond to the positions of the beams 89, 91. Two lines L1, L2, preferably passing through a center C of receptacle 13, define four quadrants Q1, Q2, Q3, Q4. As discussed earlier, each signal contact 63 corresponds to a ground contact 65 to form a contact pair 97. In the arrangement shown in FIG. 5, the signal contact 63 and ground contact 65 in each contact pair 97 have the same orientation. In other words, signal contact 63 and ground contact 65 of contact pair 97 face the same direction. Generally speaking, the orientation of each contact pair 97 within a quadrant remains the same. However, the orientation of contact pairs 97 in one quadrant differs from the orientation of contact pairs 97 in other quadrants. Typically, contact pairs 97 in one quadrant are rotated 90° relative to contact pairs 97 in an adjacent quadrant. For example, a contact pair 97 in quadrant Q1 is rotated 90° relative to a contact pair 97 in quadrant Q2.

Since one module 33 can have contacts 63, 65 residing in more than one quadrant, the orientation of some contacts 63, 65 in each module 33 can differ from the orientation of other contacts 63, 65 in the same module 33. Typically, contact pairs 97 in a module 33 that reside in one quadrant are preferably mirror images of the contact pairs 97 in the same module 33 that reside in the other quadrant. For example, module 33*a* in FIG. 5 has contact pairs 97 in quadrants Q1 and Q4. Contact pairs 97 in module 33*a* that are in quadrant Q1 are mirror images of the contact pairs 97 in quadrant Q4. Other arrangements are also possible. In an appropriate situation the contacts in one quadrant could be rotated 90° to the contacts in the adjacent quadrant.

If desired, header 11 and receptacle 13 can utilize additional shielding for higher speed operations. As an example, receptacle 13 can provide additional ground shields or pins (not shown) along lines L1, L2. Providing additional shielding along lines L1, L2 will not disturb the symmetrical nature of the present invention.

Figure 6:
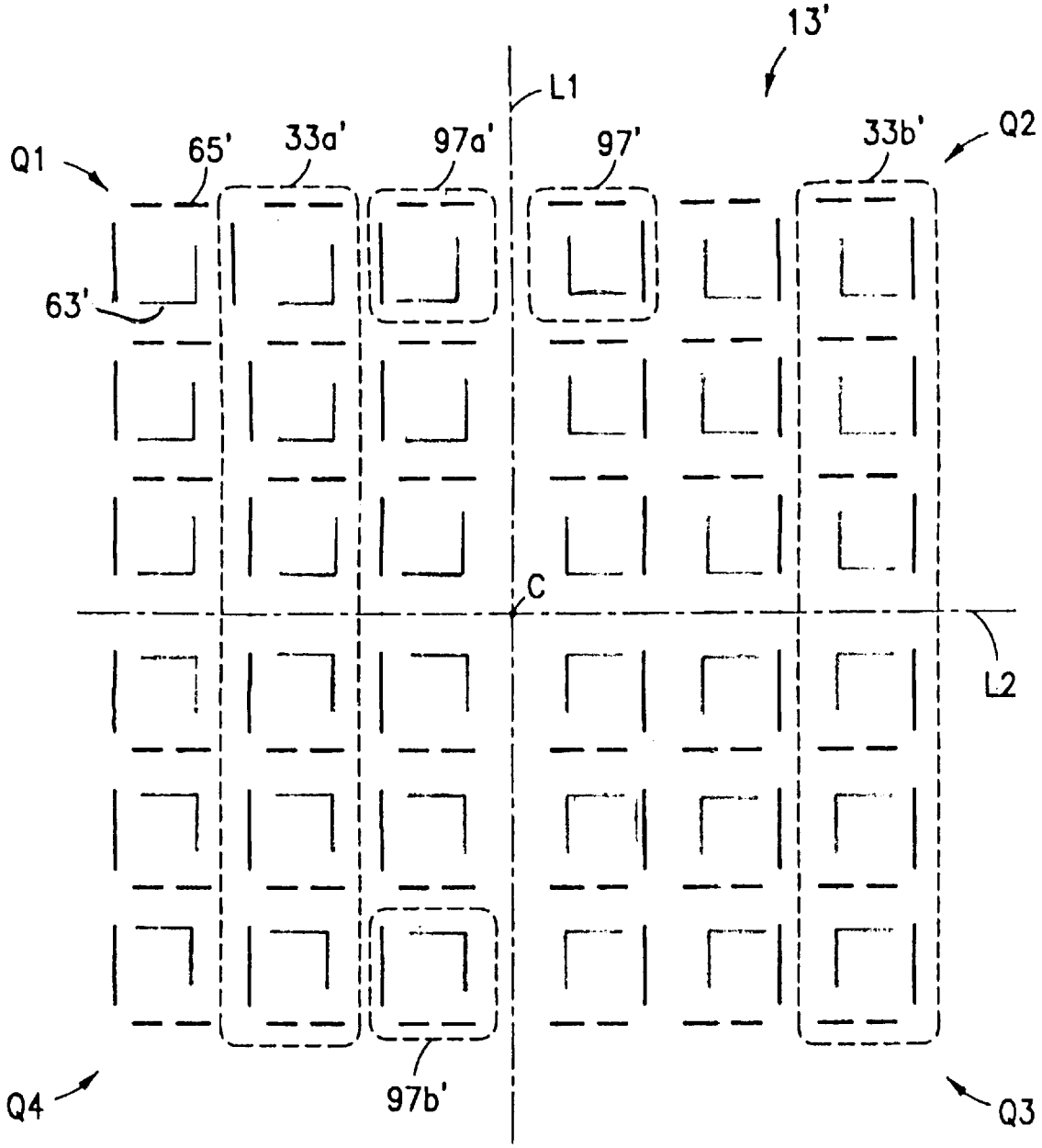
FIG. 6 is a schematic representation of an alternative contact arrangement for the second component of the present invention.

FIG. 6 provides a schematic representation of an alternative arrangement of signal contacts 63' and ground contacts 65' in receptacle 13'. Two lines L1, L2, preferably passing through a center C of receptacle 13', define four quadrants Q1, Q2, Q3, Q4. As discussed earlier, each signal contact 63' corresponds to a ground contact 65' to form a contact pair 97'. In the arrangement shown in FIG. 6, each signal contact 63' has an opposite orientation from its respective ground contact 65' in each contact pair 97'. In other words, signal contact 63' faces ground contact 65' in contact pair 97'.

Aside from the opposite orientation of signal contact 63' from ground contact 65' in each contact pair 97', the remaining features described with reference to FIG. 5 above still apply. That is, all contacts pairs 97' within a quadrant have the same orientation. Also, the orientation of contact pairs 97' in one quadrant differs from the orientation of contact pairs 97' in other quadrants. Typically, contact pairs 97' in one quadrant are rotated 90° relative to contact pairs 97' in an adjacent quadrant. Finally, contacts 63', 65' residing in module 33*a'* in one quadrant have a different orientation than the other contacts 63', 65' in module 33*b'*. Typically, contact pairs 97*a'* in module 33' that reside in one quadrant are rotated 90° relative to contact pairs 97*b'* in module 33*a'* that reside in the other quadrant.

In either arrangement shown in FIGS. 5 or 6, contacts 63, 65; 63', 65' in receptacle 13; 13' are symmetric about lines L1, L2. Since lines L1, L2 preferably pass through center C of receptacle 13; 13', contacts 63, 65; 63', 65' in receptacle 13; 13' are symmetric about center C of receptacle 13; 13'. As a result, receptacle 13; 13' can mate with header 11 in at least four orientations. When compared to conventional "polarized" connectors, the present invention provides flexibility to the design of the electrical system.

Figure 7:
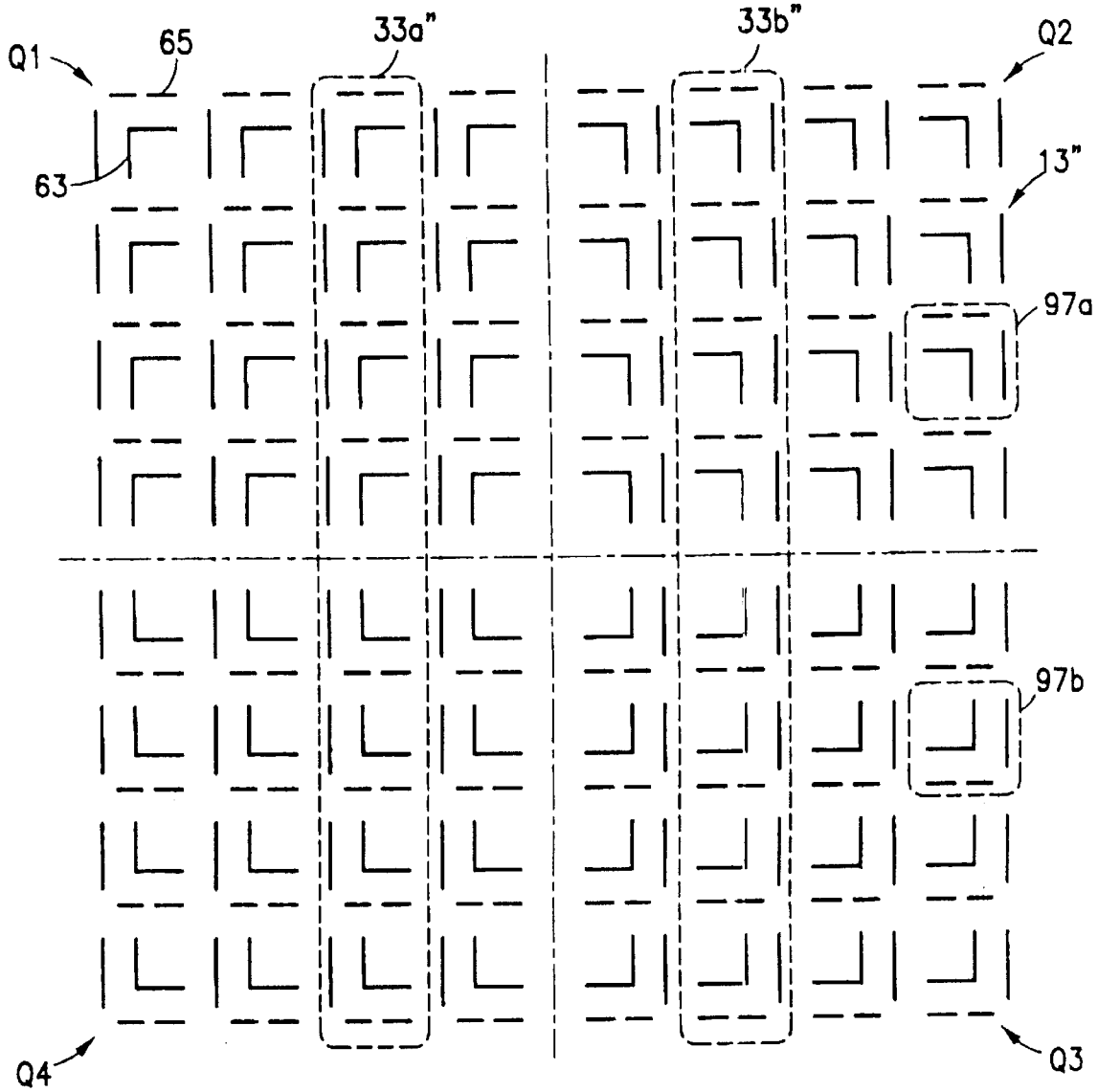
FIG. 7 is a schematic representation of another alternate contact arrangement for the second component.

Referring now to FIG. 7 a schematic view, similar to FIGS. 5 and 6, of an alternate embodiment of the receptacle 13" is shown. In this embodiment the receptacle 13" comprises an array of 64 contact pairs 97 arranged in four quadrants Q1, Q2, Q3, Q4 with 16 pairs in each quadrant. The receptacle 13" is comprised of eight modules 33" of the modules types 33*a"*, 33*b"*. Each modules 33" has eight of the pairs 97 of the contacts 63, 65; four arranged in one quadrant in one direction as pairs 97*a* and four arranged in another quadrant in a second 90° offset direction as pairs 97*b*. Any suitable number of contact pairs could be provided in each module.

Figure 8:
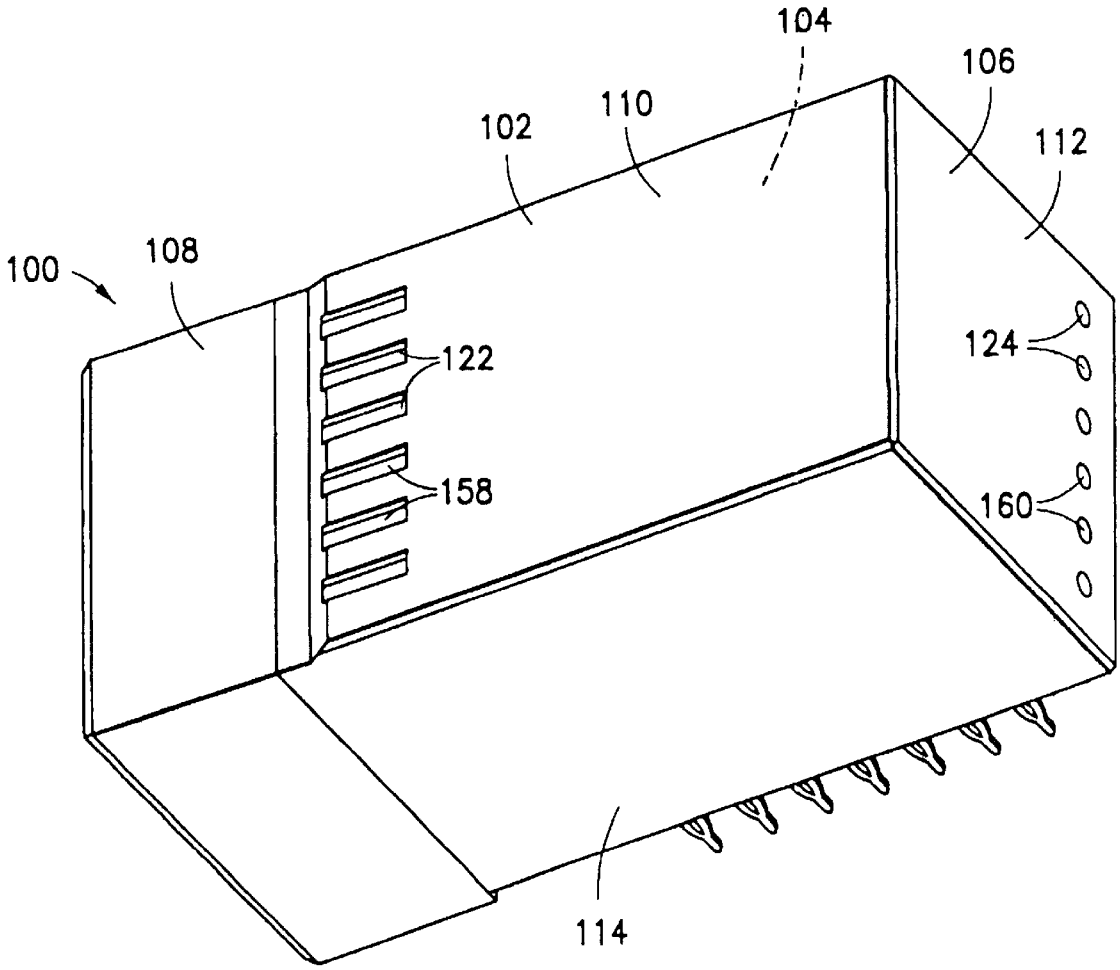
FIG. 8 is a perspective view of an alternate embodiment of the receptacle connector incorporating features of the present invention.
Figure 9:
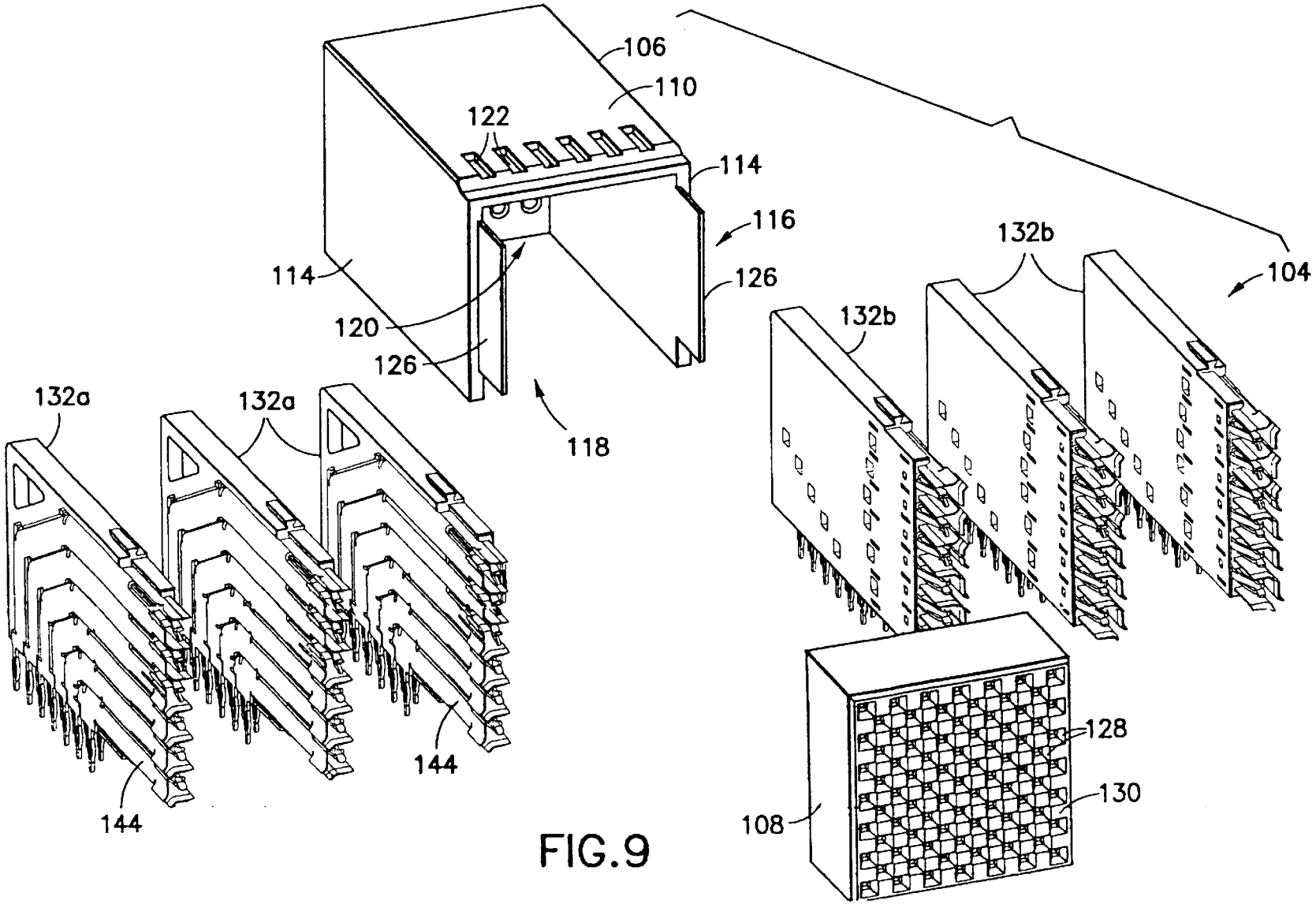
FIG. 9 is an exploded perspective view of the receptacle connector shown in FIG. 8.

Referring now to FIGS. 8 and 9 another alternate embodiment of the present invention is shown. In this embodiment the receptacle 100 generally comprises a housing 102 and a module assembly 104 connected to the housing 102. The housing 102 generally comprises a first housing member 106 and a second housing member 108. The first and second housing members 106, 108 are preferably comprised of a dielectric material, such as a molded plastic or polymer material. The first housing 106 includes a top 110, a back 112, two sides 114, a generally open front 116, a generally open bottom 118, and a receiving area 120. The top 110 includes module mounting holes 122. The back 112 includes module mounting holes 124. The front 116 includes extensions 126 from the sides 114 for insertion into and connection with the second housing member 108. The second housing member 108 includes apertures or lead-ins 128 through a front face 130 for insertion of the front ends of the mating connector's male pins into the connector 100.

Figure 10:
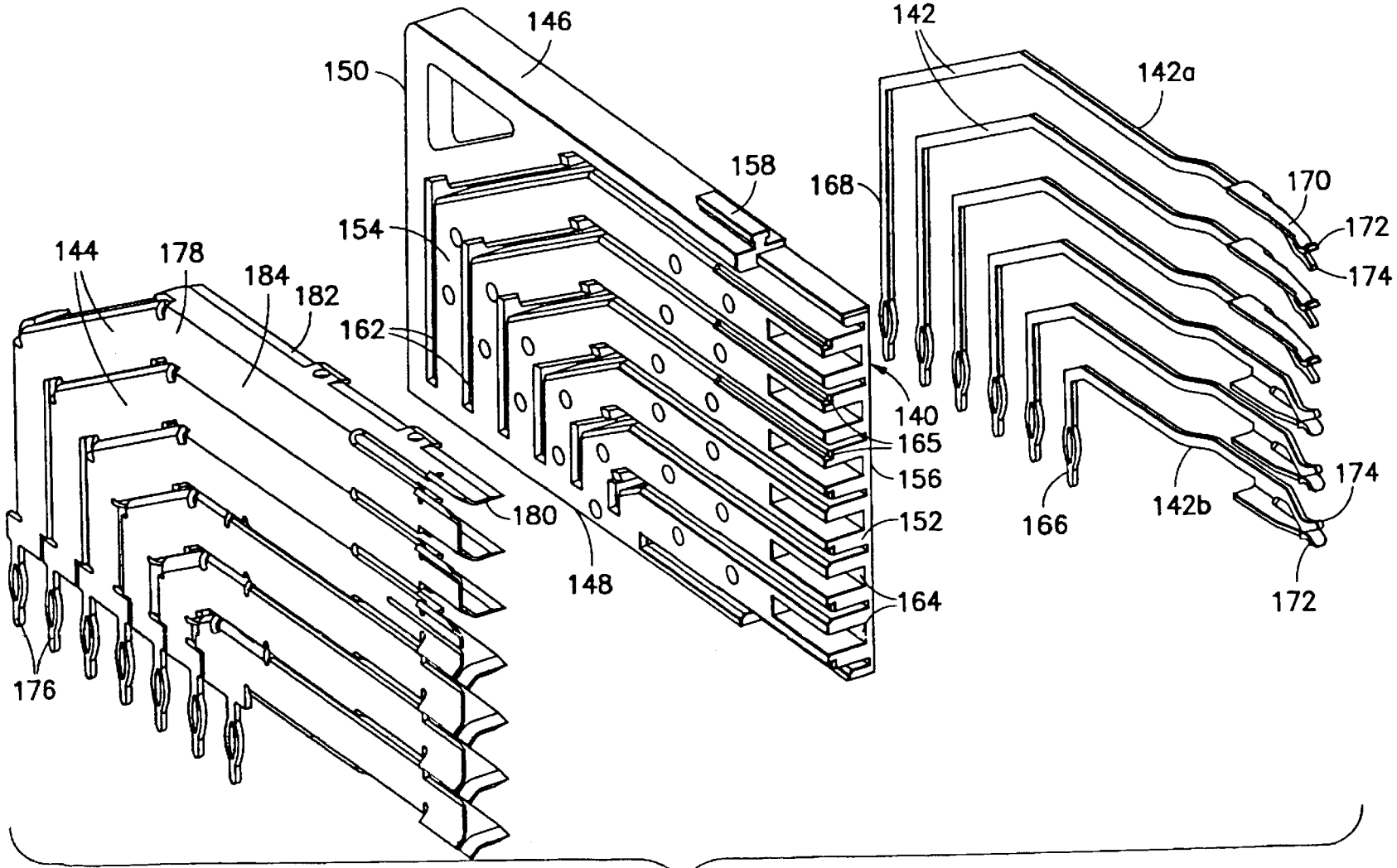
FIG. 10 is an exploded perspective view of one of the contact modules shown in FIG. 9.

The module assembly 104, in this embodiment, generally comprises six contact modules 132. In alternate embodiments more or less than six contact modules could be provided. In this embodiment the contact modules 132 comprise two sets of two types of contact modules 132*a*, 132*b* which are preferably mirror images of each other. Referring also to FIG. 10, each contact module 132 generally comprises a one-piece frame 140, signal contacts 142, and ground contacts 144. The frame 140 is preferably comprised of dielectric material, such as molded plastic or polymer. The frame 140 comprises a top side 146, a bottom side 148, a rear side 150, a front side 152, and two lateral sides 154, 156. The top side 146 includes a latch 158. The latch 158 is inserted into one of the module mounting holes 122 to connect the contact module 132 to the first housing member 106. The rear side 150 also includes a projection 160. The projection 160 is inserted into one of the module mounting holes 124 to connect the module 132 to the first housing member 106. The frame 140 includes channels 162 along at least one of the sides 154 for receiving portions of the ground contacts 144. The frame 140 could also have channels for receiving portions of the signal contacts 142. However, the frame 140 is preferably overmolded onto portions of the signal contacts 142. Alternatively, or additionally, the frame 140 could be over-molded onto portions of the ground contacts 144. The front side 152 of the frame 140 includes pockets 164 and receiving areas 165.

In this embodiment each contact module has six of the signal contacts 142; three as a first type 142*a* of signal contacts and three as a second type 142*b* of signal contacts. The signal contacts 142 each have a first end 166, a middle section 168, and a second end 170. The first ends 166 have through-hole solder tails, but any suitable first ends could be provided, such as surface mount solder tails. The middle sections 168 all have right, turn shapes, but with different lengths or dimensions to allow the signal contacts to be aligned in a row or common plane. The second ends 170 each comprise two deflectable arms 172, 174 oriented 90° offset from each other. The arms 172, 174 in the first type of signal contact 142*a* are orientated as mirror images of the arms 172, 174 in the second type of signal contacts 142*b*. In alternate embodiments other types or orientations of the second ends could be provided.

The ground contacts 144 for each module 132 can be provided as a single one-piece member or multiple members as shown. Each ground contact 144 includes a first end 176, a middle section 178, and a second end 180. The first ends 176 have press-fit tails. However, any suitable type of first ends could be provided, such as surface mount solder tails. The middle sections 178 generally comprise first sections 182 and second sections 184. The first sections 182 are located in the slots 162 of the frame 140 to fixedly connect the ground contacts 144 to the frame 140. The second sections 184 extend along the side surface 154 of the frame 140. The middle sections 178 have a general right turn shape such that the two ends 176, 180 are at a general right angle to each other. However, any suitable shape of the middle sections could be provided.

Figure 11:
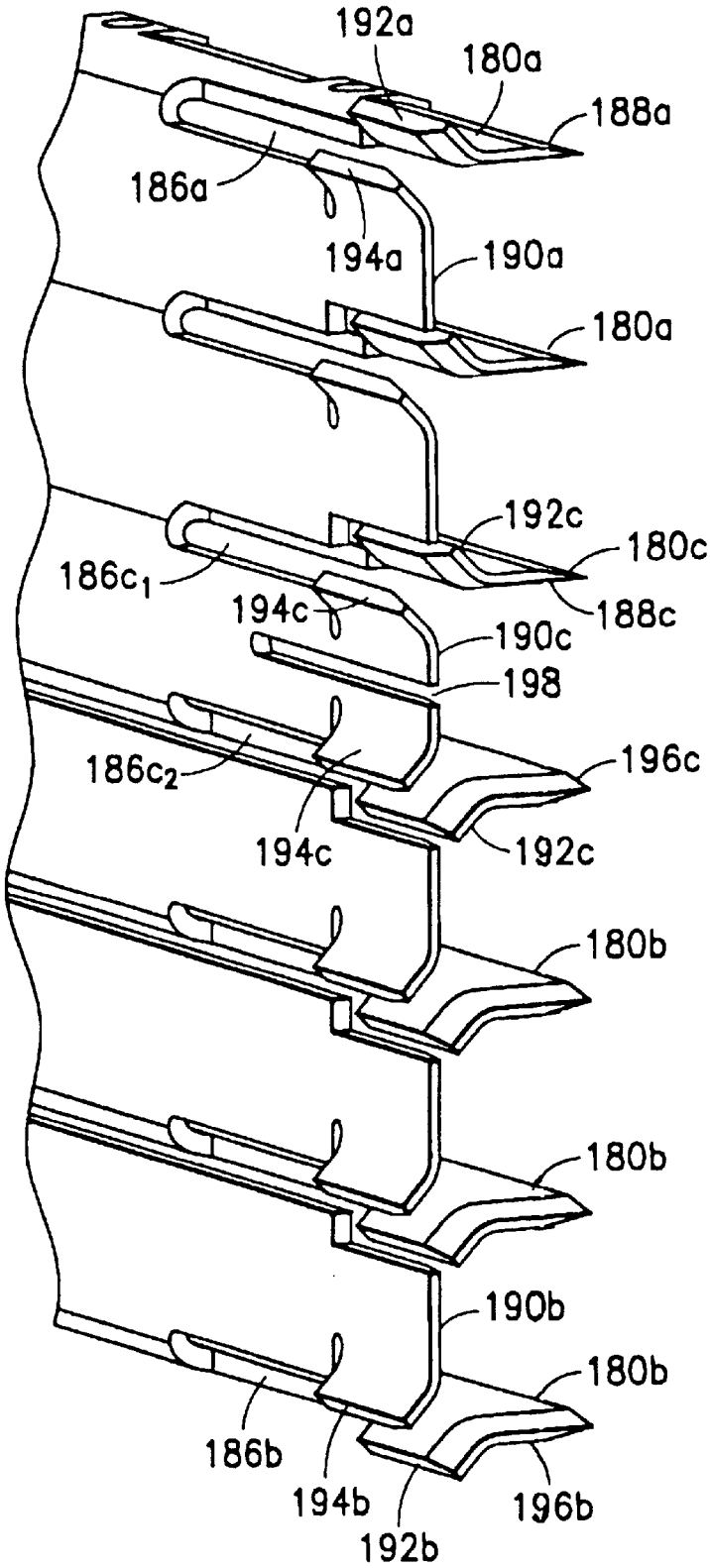
FIG. 11 is an enlarged partial perspective view of one end of the ground contacts shown in FIG. 10.

Referring also to FIG. 11, the second ends 180 include three different types of second ends 180*a*, 180*b*, 180*c*. The first type of second end 180*a* has a slot 186*a* at a corner with a top arm 188*a* and a side arm 190*a* on opposite sides of the slot 186*a*. Two deflectable projections 192*a*, 194*a* extend from the arms 188*a*, 190*a*. The second type of second end 180*b* is generally a mirror image of the first type of second end 180*a*. The second type of second end 180*b* has a slot 186*b* at a corner with a side arm 190*b* and a bottom arm 196*b*. Two deflectable projections 192*b*, 194*b* extend from the arms 196*b*, 190*b*. The third type of end 180*c* has two slots 186$c_1$, 186$c_2$ at two corners with a top arm 188*c*, a bottom arm 196*c* and a side arm 190*c*. Two deflectable projections 192*c*, 194*c* extend into the first slot 186*c*, and two deflectable projections 192*c*, 194*c* extend into the second slot 186$c_2$. The side arm 190*c* also includes a third slot 198. However, in alternate embodiments, any suitable type(s) of second ends could be provided.

Referring back to FIG. 9, when the module assembly 104 is assembled the ground contacts 144 combine to effectively surround the signal contacts to form an electromagnetic shielding for the signal contacts.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector, comprising:

an insulative housing; and a plurality of signal and ground contacts in said insulative housing;

wherein said connector has four quadrants, each quadrant housing a portion of said plurality of signal and ground contacts, all signal contacts in one quadrant being oriented different relative to an orientation of signal contacts in all other ones of said quadrants, wherein the signal contacts comprise a mating end with a general L shape, and wherein the signal contacts in each quadrant are orientated as a general mirror image to orientation of the signal contacts in the two adjacent quadrants.

2. The electrical connector as recited in claim 1, wherein said orientation is rotated 90° relative to adjacent quadrants.

3. An interconnection system, comprising:

a first connector having an arrangement of signal and ground contacts therein; and a second connector, mateable with said first connector, and having a second arrangement of pairs of signal and ground contacts therein, the pairs of contacts being arranged in different parts of the second connector, each part having multiple ground contacts and the ground contacts in each respective part being orientated in a same orientation in that part;

wherein said ground contacts comprise a mating end with a general L shaped cross section, wherein all of said ground contacts in a first one of the parts of the second arrangement are oriented different relative to said ground contacts in all other ones of the parts of the second arrangement, and wherein said second corrector is mateable with said first connector in a plurality of orientations without shorting any of said signal contacts of said first connector to any of said ground contacts of said second connector.

4. The interconnection system as recited in claim 3, wherein said arrangement of contacts in said first and second connectors are symmetrical.

5. The interconnection system as recited in claim 4, wherein said arrangement of contacts in said first and second connectors are symmetrical about a line.

6. The interconnection system as recited in claim 5, wherein said line passes through the center of each said first and second connector.

7. The interconnection system as recited in claim 4, wherein said arrangement of contacts in said first and second connectors are symmetrical about a point.

8. The interconnection system as recited in claim 7, wherein said point resides at the center of each said first and second connector.

9. The interconnection system as recited in claim 3, wherein each of said contacts in at least one of said first and second connectors resides in the parts comprising one of four quadrants, all of said contacts in one quadrant being oriented different than said contacts in other ones of said quadrants.

10. The interconnection system as recited in claim 9, wherein each of said contacts in one quadrant is oriented with a cross-section rotated approximately 90° from each of said contacts in an adjacent quadrant.

11. The interconnection system as recited in claim 3, wherein said contacts in said first and second connectors comprise signal contacts and ground contacts, each said ground contact being located proximate a respective one of said signal contacts to form a contact pair.

12. The interconnection system as recited in claim 11, wherein said signal and ground contacts of each said contact pair are generally orientated in a same direction.

13. The interconnection system as recited in claim 3, wherein said signal and ground contacts of each said contact pair are orientated in substantially opposite directions.

14. The interconnection system as recited in claim 11, wherein said second connector is mateable with said first connector in at least two orientations.

15. The interconnection system as recited in claim 3, wherein said second connector is mateable with said first connector in at least four orientations.

16. The interconnection system as recited in claim 3, wherein said contacts in said first and second connectors form an equal number of rows and columns.

17. An interconnection system, comprising:

a first connector having a first housing and a first arrangement of first contacts, therein; and a second connector, mateable with the first connector, and having a second housing and a second arrangement of second contacts therein;

wherein the second connector is mateable with the first connector in a plurality of orientations without shorting any of said contacts, and wherein at least one of the first and second connectors has its contacts arranged in four quadrants, each quadrant having at least two ground contacts and two signal contacts, wherein the ground contacts comprise a mating end with a general L shaped cross section, and wherein a majority of contacts in a first one of the quadrants being oriented respectively differently relative to contacts in second, third and fourth ones of the quadrants.

18. A connector assembly, comprising:

a plug connector having an arrangement of contacts therein comprising signal and ground contacts; and a receptacle connector conjugally mateable with said plug connector, and having a second arrangement of contacts therein comprising signal and ground contacts;

wherein the signal contacts comprise a mating end with a general L shape, wherein a majority of signal contacts in the second arrangement is oriented differently relative to each other, and wherein said receptacle connector and said plug connector are conjugally mateable in a plurality of orientations without shorting any of said signal and ground contacts.

19. The connector assembly as recited in claim 18, wherein said arrangement of contacts in said plug and receptacle connectors comprises an array having symmetrical rows and columns, and wherein the array is symmetrically distributed about a center point of said plug and receptacle connectors.

* * * * *